US007909646B2

(12) United States Patent
Feldman et al.

(10) Patent No.: US 7,909,646 B2
(45) Date of Patent: Mar. 22, 2011

(54) ELECTRICAL CARRIER ASSEMBLY AND SYSTEM OF ELECTRICAL CARRIER ASSEMBLIES

(75) Inventors: Steven Feldman, Cedar Park, TX (US); Joseph N. Castiglione, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/538,560

(22) Filed: Aug. 10, 2009

(65) Prior Publication Data

US 2011/0034072 A1 Feb. 10, 2011

(51) Int. Cl.
*H01R 9/05* (2006.01)

(52) U.S. Cl. ..... 439/579; 439/108; 439/607.1

(58) Field of Classification Search ..... 439/578, 439/579, 607.05, 607.15, 607.08, 108, 101, 439/607.49, 607.53, 607.1, 712
See application file for complete search history.

(56) References Cited

U.S. PATENT DOCUMENTS

| | | | | |
|---|---|---|---|---|
| 3,587,028 | A * | 6/1971 | Uberbacher | 439/49 |
| 4,707,045 | A * | 11/1987 | Ney et al. | 439/588 |
| 5,114,355 | A | 5/1992 | Kimmel et al. | |
| 5,184,965 | A | 2/1993 | Myschik et al. | |
| 5,194,020 | A | 3/1993 | Voltz | |
| 5,496,183 | A | 3/1996 | Soes et al. | |
| 5,516,294 | A | 5/1996 | Andrews et al. | |
| 5,645,450 | A * | 7/1997 | Yamada et al. | 439/585 |
| 5,904,594 | A | 5/1999 | Longueville et al. | |
| 5,906,511 | A * | 5/1999 | Bozzer et al. | 439/579 |
| 5,980,321 | A | 11/1999 | Cohen et al. | |
| 5,993,259 | A | 11/1999 | Stokoe et al. | |
| 6,056,559 | A * | 5/2000 | Olson | 439/108 |
| 6,146,202 | A | 11/2000 | Ramey et al. | |
| 6,231,391 | B1 | 5/2001 | Ramey et al. | |
| 6,238,245 | B1 | 5/2001 | Stokoe et al. | |
| 6,299,483 | B1 | 10/2001 | Cohen et al. | |
| 6,358,062 | B1 | 3/2002 | Feldman et al. | |
| 6,368,120 | B1 | 4/2002 | Scherer et al. | |
| 6,371,813 | B2 | 4/2002 | Ramey et al. | |
| 6,379,188 | B1 | 4/2002 | Cohen et al. | |
| 6,447,328 | B1 * | 9/2002 | Feldman | 439/482 |
| 6,503,103 | B1 | 1/2003 | Cohen et al. | |

(Continued)

FOREIGN PATENT DOCUMENTS

WO WO 2007/089853 A1 8/2007

OTHER PUBLICATIONS

Amphenol TCS, VHDM Connector, http://www.amphenol-tcs.com/products/connectors/backplane/vhdm/index.html, printed on Feb. 25, 2008, 4 pages.

(Continued)

*Primary Examiner* — Hae Moon Hyeon
(74) *Attorney, Agent, or Firm* — Robert S. Moshrefzadeh; Melanie G. Gover

(57) ABSTRACT

A male coaxial connector includes at least one termination device having a tubular shield surrounding and isolated from a pin that is configured to electrically connect with a socket of a female termination device, and a plate extending from one of a leading end of the tubular shield and a leading end of the female termination device. Upon electrical interconnection, the plate forms a ground circuit extending between the at least one termination device and a ground of the female termination device.

2 Claims, 13 Drawing Sheets

U.S. PATENT DOCUMENTS

| | | | | |
|---|---|---|---|---|
| 6,506,076 | B2 | 1/2003 | Cohen et al. | |
| 6,520,802 | B1 | 2/2003 | Mitra | |
| 6,551,126 | B1 | 4/2003 | Feldman | |
| 6,554,647 | B1 | 4/2003 | Cohen et al. | |
| 6,607,402 | B2 | 8/2003 | Cohen et al. | |
| 6,712,646 | B2 | 3/2004 | Shindo | |
| 6,833,513 | B1 | 12/2004 | Ahmad | |
| 6,971,916 | B2 * | 12/2005 | Tokunaga | 439/607.09 |
| 7,048,585 | B2 | 5/2006 | Milbrand, Jr. et al. | |
| 7,114,964 | B2 | 10/2006 | Winings et al. | |
| 7,144,240 | B2 | 12/2006 | Maravilla | |
| 7,553,187 | B2 | 6/2009 | Feldman | |
| 7,607,944 | B2 * | 10/2009 | Yoshioka et al. | 439/579 |
| 7,744,414 | B2 | 6/2010 | Scherer | |
| 2001/0005654 | A1 | 6/2001 | Cohen et al. | |
| 2002/0111068 | A1 | 8/2002 | Cohen et al. | |
| 2003/0052755 | A1 | 3/2003 | Barnes et al. | |
| 2007/0141871 | A1 | 6/2007 | Scherer et al. | |
| 2007/0197095 | A1 | 8/2007 | Feldman et al. | |
| 2009/0104800 | A1 * | 4/2009 | Scherer | 439/101 |
| 2009/0104809 | A1 | 4/2009 | Feldman | |
| 2010/0009571 | A1 * | 1/2010 | Scherer et al. | 439/607.05 |
| 2010/0062629 | A1 * | 3/2010 | Feldman et al. | 439/219 |

OTHER PUBLICATIONS

3M MetPak™ HSHM Backplane Connectors, Innovation HSHM Brochure, Copyright 3M 2002, 4 pages, 3M Electronic and Interconnect Solutions Division, Austin, TX.

PCT International Search Report, PCT/US2010/044102.

* cited by examiner

ELECTRICAL CARRIER ASSEMBLY AND SYSTEM OF ELECTRICAL CARRIER ASSEMBLIES

BACKGROUND

The connection of integrated circuits on circuit boards to cables or electronic devices is known in the art. Signals propagate through conductors of the connector as they pass to/from the circuit board. Electrical interconnections are not difficult to form when signal line densities are relatively low. In addition, signal integrity is much less of a concern when designing connectors for slow signal speed and/or slow data rate applications. However, equipment manufacturers and consumers continually desire ever higher signal line densities and faster data rates.

The available high speed interconnect solutions are typically complex, utilizing precisely fabricated component designs that are sensitive to even small manufacturing variations, and thus expensive and difficult to manufacture.

It is desirable to provide electrical connectors and connections between circuit boards, cables, or electronic devices having improved cost/performance ratio, high circuit switching speeds, increased signal line densities with controlled electrical characteristics, and improved/controlled signal integrity in a manner suited to meet the evolving demands of end users.

SUMMARY

One aspect provides a male coaxial connector including at least one termination device having a tubular shield surrounding and isolated from a pin that is configured to electrically connect with a socket of a female termination device, and a plate extending from one of a leading end of the tubular shield and a leading end of the female termination device. Upon electrical interconnection, the plate forms a ground circuit extending between the at least one termination device and a ground of the female termination device.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope, of the present invention is defined by the appended claims.

It is to be understood that the features of the various exemplary embodiments described herein may be combined with each other, unless specifically noted otherwise.

Embodiments provide a high speed electrical connector having high signal line density and shielded controlled impedance for all signal lines. Other embodiments provide a male adaptor configured to convert a female connector to a male connector having a male pin and a plate, where the male connector is configured to form a ground path with a female connector and provide high signal line density and shielded controlled impedance. Other embodiments provide a carrier assembly including multiple such male connectors having reduced propagation delay, improved impedance tolerance, higher band width, and lower insertion losses.

Figure 1:
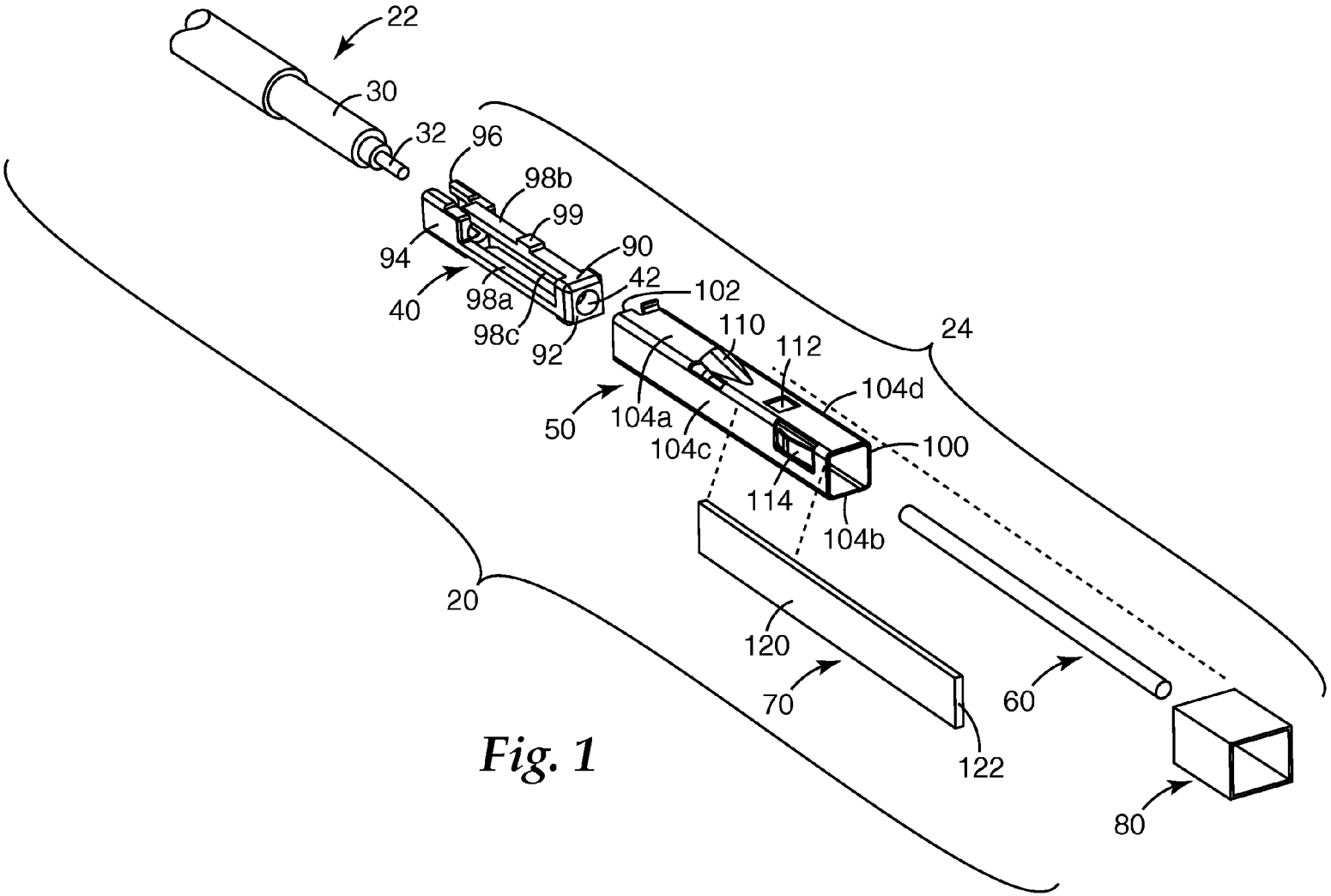
FIG. 1 is an exploded perspective view of a male coaxial connector according to one embodiment.

FIG. 1 is an exploded perspective view of a male coaxial connector 20 according to one embodiment. A single male coaxial connector 20 is configured to electrically couple with a single female connector, as described below. Alternatively, multiple male coaxial connectors 20 are organized into an assembly, as described below, and configured to electrically couple with an assembly of female connectors. With this in mind, male coaxial connector 20 provides a termination assembly 20. In one embodiment, male coaxial connector 20 includes a cable 22 terminated to a termination device 24, where termination device 24 is suited for termination to a female connector.

Cable 22 includes single wire cables (e.g., single coaxial or single twinaxial), multiple wire cables (e.g., multiple coaxial, multiple twinaxial, or twisted pair), or other suitable electrical cables. Cable 22 includes a ground shield 30 surrounding a central conductor 32. Ground shield 30 is sized to be received by a shield 50 of termination device 24 as described below, and in one embodiment ground shield 30 is stiffened in a solder dip process to form a prepared end portion of cable 22. Conductor 32 is configured to couple with a conducting pin of termination device 24, for example via crimping or soldering, to form an electrical communication path through portions of termination device 24.

In one embodiment, termination device 24 includes an insulator 40 defining a receptacle 42, shield 50 disposed about insulator 40, a pin 60 insertable into receptacle 42, a plate 70 in electrical contact with shield 50, and an optional housing 80 configured to surround a portion of shield 50 and plate 70. Shield 50 is isolated from pin 60 by insulator 40.

In one embodiment, insulator 40 includes a first member 90 defining a first end 92, a second member 94 defining a second end 96, and bars 98*a*, 98*b*, 98*c* extending between members 90, 94. Insulator 40 is generally axially aligned within shield 50 and receptacle 42 is provided to receive and maintain pin 60 inside of insulator 40 and shield 50. Receptacle 42 is formed in first member 90 and second member 94 and extends between first end 92 and second end 96 to provide an opening that is sized to receive and enable pin 60 to connect with conductor 32.

In one embodiment, insulator 40 is substantially solid (e.g., characterized by an absence of voids) and receptacle 42 is formed in the solid insulator 40. In another embodiment, insulator 40 is "skeletonized" where the first and second members 90, 94 provide structural support for insulator 40 and bars 98 extend between the structural supports of members 90, 94 to position members 90, 94 a desired distance away one from the other. Although three bars 98*a*, 98*b*, 98*c* are shown, insulator 40 is suitably skeletonized with as few as a single bar 98 or more than three bars 98. In one embodiment, at least bar 98*b* includes a pad 99 projecting from an exterior surface of bar 98*b*, where pad 99 is configured to engage with an opening formed in shield 50 to retain insulator 40 inside shield 50.

In one embodiment, insulator 40 defines a non-circular cross-sectional shape having planar exterior surfaces. Other suitable shapes for insulator 40 are also acceptable. Although the illustrated embodiment of insulator 40 defines a substantially square cross-sectional shape, it is to be understood that insulator 40 is suitably formed to define other cross-sectional shapes including rectangular, non-circular, circular, or other curvilinear shapes. Insulator 40 is fabricated of suitable electrically insulating materials, such as plastic, organic dielectrics or inorganic dielectrics.

In one embodiment, shield 50 is a tubular member extending between a leading end 100 opposite a trailing end 102 and includes sides 104*a*, 104*b*, 104*c*, 104*d* extending between ends 100, 102. Sides 104*a*-104*d* ("sides 104") combine to define a cross-sectional shape that is suited to receive insulator 40. Although the illustrated embodiment of shield 50 provides four sides 104 defining a substantially square transverse cross-section, it is to be understood that shield 50 acceptably includes other rectangular, non-circular, or circular transverse cross-sections. Shield 50 is fabricated of suitable electrically conducting materials, such as aluminum, alloys of aluminum, copper, alloys of copper, bronze, or metal in general.

In one embodiment, at least side 104*a* is fabricated to include a latch 110 and an opening 112. Latch 110 extends from side 104*a* and is configured to retain termination device 24 within a retainer or an organizer plate (not shown) that is configured to receive, secure, or manage a plurality of like termination devices. It is desirable to fabricate latch 110 to yield (i.e. break or deform) at a lower force than is required to break or deform the attached cable 22 to enable termination assembly 20 to be removable from the retainer or organizer plate when repairing or replacing termination assembly 20. One or more suitably formed latches 110 are fabricated on one or more of sides 104 to facilitate the removable securing of termination device 24 within a retainer/organizer plate.

Opening 112 is formed in side 104*a* and is sized to receive pad 99 of insulator 40. For example, when insulator 40 is inserted into shield 50, bar 98*b* and pad 99 deflect inwardly until pad 99 engages with opening 112. Beneficially, if insulator 40 is improperly assembled into shield 50 (such that pad 99 is not aligned or engaged with opening 112) pad 99 will cause shield 50 to bulge. The bulging shield 50 indicates that termination device has been improperly assembled, and provides a visual indicator to a user that termination assembly 20 will not fit within a carrier or an organizer plate, which prevents the improper installation and use of termination assembly 20.

In one embodiment, at least side 104*c* is fabricated to include a ground beam 114 that projects away from shield 50. Ground beam 114 provides a protruding resilient ground contact extending from a surface of shield 50 and is configured to electrically couple with plate 70. Plate 70 coupled to ground beam 114 provides termination assembly 20 with a grounding pathway extending beyond leading end 100 of shield 50. It is within the scope of this disclosure to employ other contact elements, such as Hertzian bumps for example, in addition to or in place of ground beam 114. Although one ground beam 114 is illustrated, it is to be understood that two or more sides 104 of shield 50 is suitably fabricated to include one or more ground beams 114.

Pin 60 provides an elongated metal electrical path to conductor 32. Pin 60 is sized to couple with conductor 32 on one end and extend beyond shield 50 on an opposite end in a "male" configuration. In one embodiment, pin 60 is a male signal pin that is crimped or soldered to conductor 32 and projects a distance beyond leading end 100 of shield 50 in a manner that is suited for coupling into a female receptacle. Suitable materials for fabricating pin 60 include electrically conducting metals such as aluminum, alloys of aluminum, copper, alloys of copper, silver, or gold or other suitable electrically conducting metals.

Plate 70 generally includes a planar member 120 terminating in a finger 122. Acceptable shapes for plate 70 include a rectangular shape in which planar member 120 has a width that is about equal to a width of finger 122, or compound shapes in which a plurality of fingers 122 extend from a planar member 120 that is wider than any one of the fingers 122. With any of the configurations, when termination assembly 20 is assembled, planar member 120 is electrically coupled to ground, beam 114 and finger 122 extends beyond the leading end 100 of shield 50 to provide a grounding pathway with a complementary coupled female receptacle. Suitable materials for fabricating plate 70 include electrically conducting metals such as aluminum, alloys of aluminum, copper, alloys of copper, silver, or gold.

Housing 80 provides a tubular section that is configured to enclose a portion of shield 50 and secure plate 70 against ground beam 114. In one embodiment, housing 80 is fabricated of an insulative material such as plastic and is press-fit, molded, or otherwise secured around a portion of shield 50 and plate 70. In other embodiments, housing 80 is integrally formed (e.g., molded) over an entirety of shield 50 and that portion of plate 70 in contact with shield 50.

Figure 2:
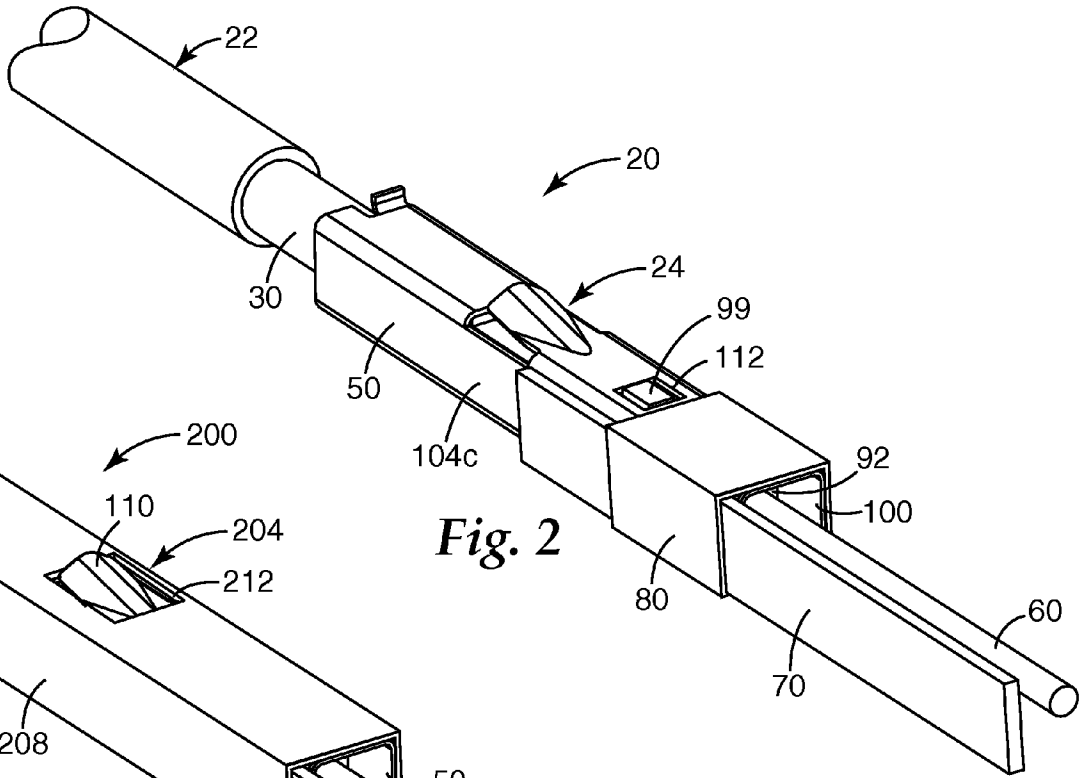
FIG. 2 is a perspective view of the male coaxial connector shown in FIG. 1 as assembled.

FIG. 2 is a perspective view of termination assembly 20 as assembled. Pad 99 of insulator 40 projects through opening 112 and retains insulator 40 within shield 50. Ground shield 30 is inserted into and contacts an interior surface of shield 50, and pin 60 is inserted into insulator 40 and electrically communicates with conductor 32 (FIG. 1). Pin 60 extends beyond leading end 100 of shield 50 to provide a male signal path electrically communicating with cable 22. Plate 70 is in electrical communication with shield 50 through the resilient ground beam 114 (FIG. 1). Plate 70 extends beyond leading end 100 of shield 50 to provide a metal grounding path with a connected female connector/termination device (not shown).

Figure 3:
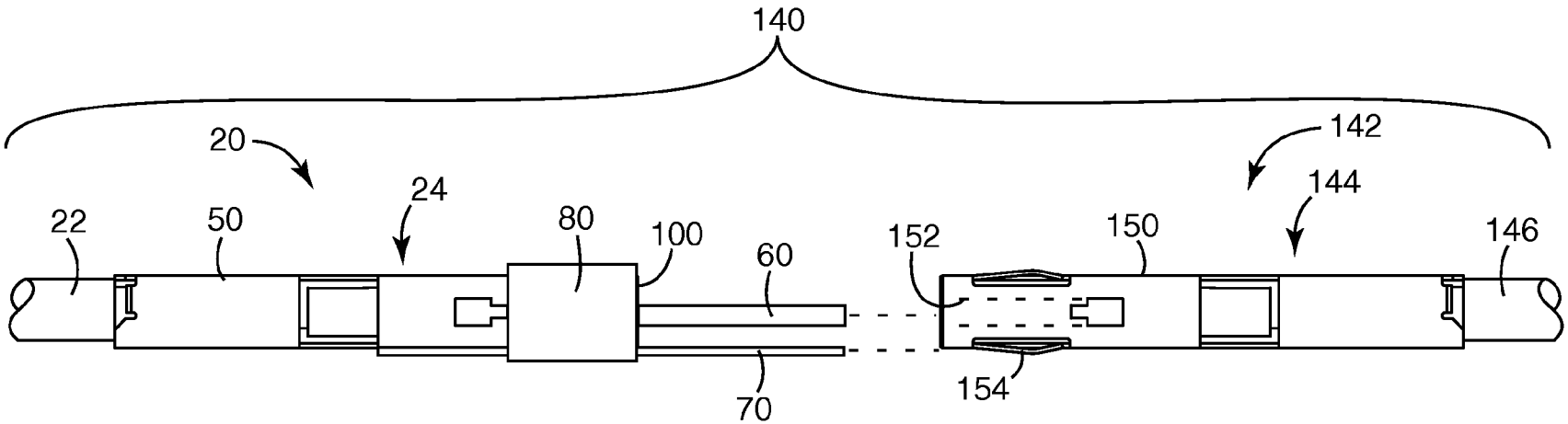
FIG. 3 is a top view of the male coaxial connector shown in FIG. 2 positioned for coupling with a female connector.

FIG. 3 is a top view of a system 140 of interconnecting termination assemblies 20, 142 according to one embodiment. Termination assembly 20 includes termination device 24 having a male pin 60 and plate 70 that extend from a leading end 100 of shield 50. Termination assembly 142 or connector 142 includes a female termination device 144 terminated to a cable 146, where female termination device 144 includes a shield 150 that defines a receptacle 152 and a ground wiper 154.

Male termination device 24 is insertable into female termination device 144, and when so assembled, male pin 60 inserts into receptacle 152 and plate 70 contacts ground wiper 154 to commonly ground termination assembly 142 to termination assembly 20. Cables 22, 146 are in electrical communication and terminal device 24 is commonly grounded with terminal device 144. Pin 60 electrically communicates between cables 22, 146 to provide a direct electrical interface for improved reliability and lower line resistance. System 140 is not reliant on a mating interface or other alignment device between termination devices 24, 144, and as such, provides improved impedance tolerance and higher band width for carrier assemblies 20, 142. Pin 60 is surrounded by shield 50, which beneficially isolates signal pin 60 from adjacent electrical interference. When system 140 is assembled, pin 60 is entirely shielded from external electromagnetic interference (EMI).

Figure 4B:
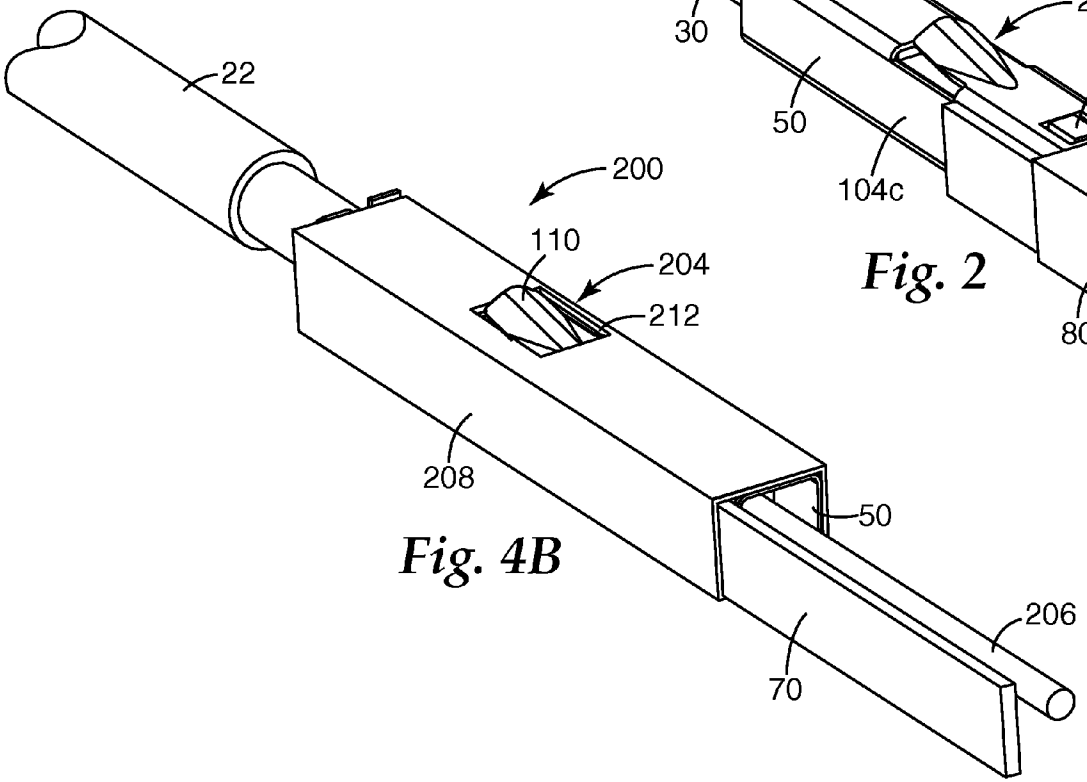
FIG. 4B is a perspective view of the male coaxial connector shown in FIG. 4A as assembled.
Figure 4A:
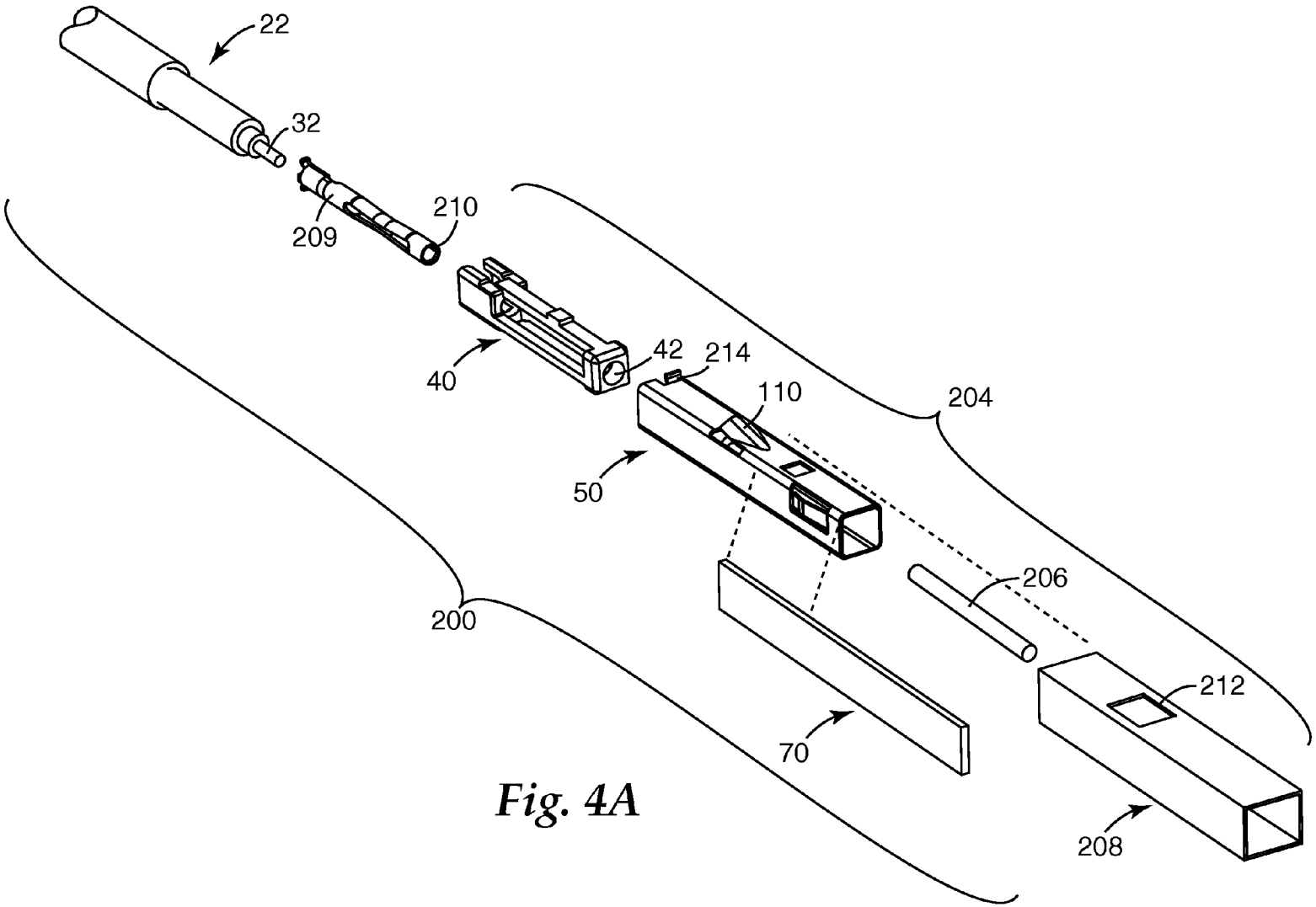
FIG. 4A is an exploded perspective view of a male coaxial connector according to another embodiment.

FIG. 4A is an exploded perspective view of a termination assembly 200 according to another embodiment. Termination assembly 200 includes cable 22 as described above having conductor 32 coupleable to another termination device 204. Termination device 204 includes insulator 40 that defines receptacle 42, shield 50 disposed about insulator 40, plate 70 that connects with shield 50, and a pin 206 that connects with conductor 32 by way of conductor 209.

In one embodiment, pin 206 electrically couples with contact 209 disposed within insulator 40. Pin 206 is an electrical conductor that is configured to project from shield 50 to provide a male electrical connection with complementary connected female connectors. Contact 209 is crimped or soldered to conductor 32 and is disposed within insulator 40. Pin 206 is insertable into receptacle 42 and couples with an opening 210 defined in contact 209 to complete an electrical connection with conductor 32.

An optional housing 208 is provided that is configured to enclose shield 50. Housing 208 is configured to slide over shield 50 and plate 70, substantially enclosing shield 50. In one embodiment, housing 208 defines a window 212 that is sized to receive latch 110. When housing 208 engages with shield 50, latch 110 is engaged in window 212 and a tab 214 formed on shield 50 limits longitudinal motion of housing 208 in the direction of cable 22. In this manner, latch 110/window 212 and tab 214 combine to restrict the longitudinal motion of housing 208 relative to shield 50. Insulator 40, shield 50, and plate 70 are described above and are configured to cooperate with pin 206 and contact 209 to provide a male termination device 204.

FIG. 4B is a perspective view of termination assembly 200 as assembled. Pin 206 and plate 70 extend opposite of cable 22 beyond shield 50 and housing 208. In a manner similar to system 140 described above in FIG. 3, pin 206 provides a male interconnect suited for insertion into a receptacle of a female termination device or female carrier assembly, and shield 70 is configured to commonly ground with the connected female device or assembly.

Embodiments described above provide a male termination device including a plate that extends parallel to a male pin of the device to form a ground path between the male termination device and an interconnected female termination device or carrier assembly.

Embodiments described below provide a structure that organizes a plurality of male termination devices, each in contact with a common plate and configured to have a common ground path to an interconnected female termination device or carrier assembly. Embodiments of such a structure as described below provide a plurality of male termination devices accurately aligned within an organizer array, where the organizer includes column organizer plates each having ground path fingers extending parallel alongside pins of the male termination devices.

Figure 5A:
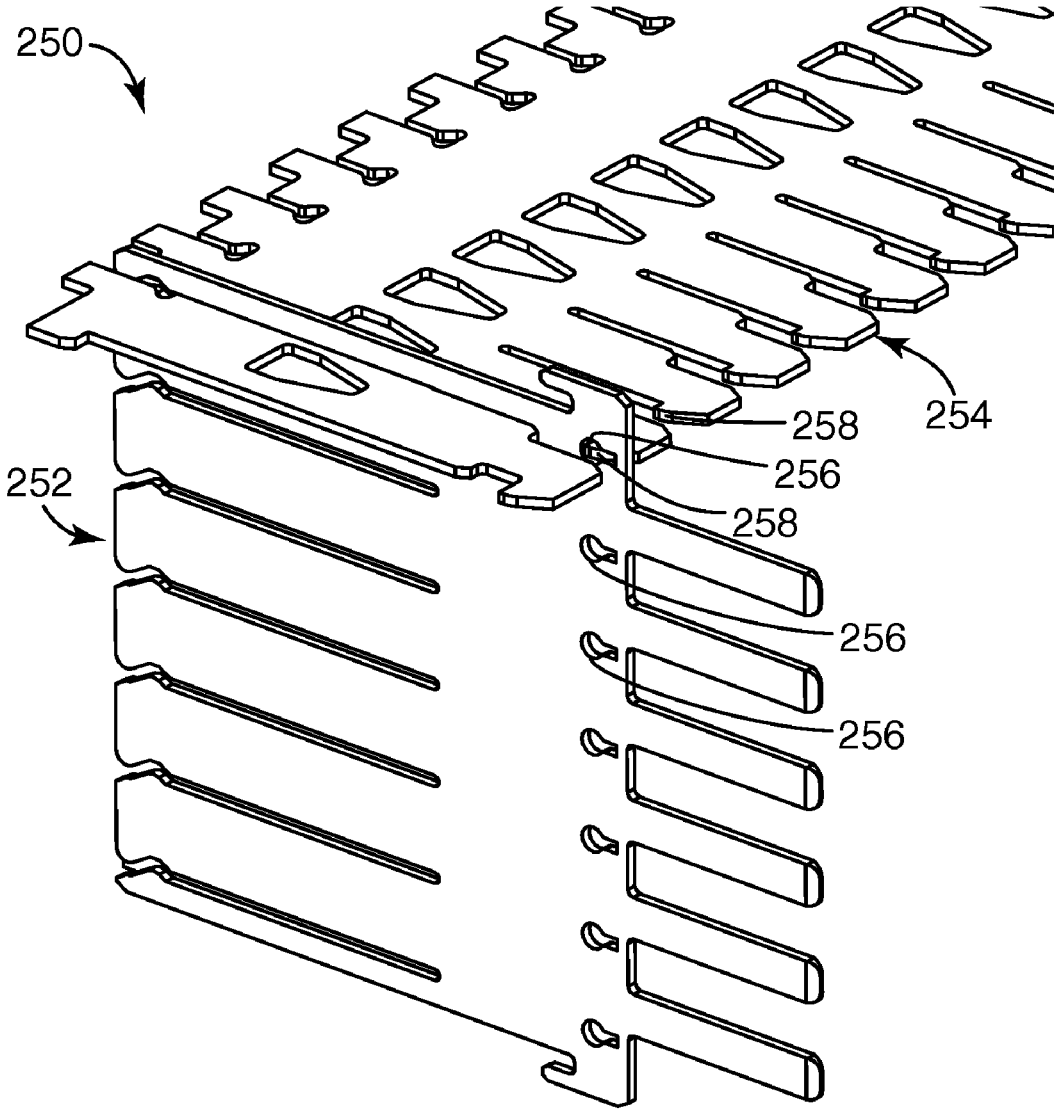
FIG. 5A is a perspective view of a portion of an organizer that is configured to align multiple male coaxial connectors within a carrier assembly according to one embodiment.
Figure 5B:
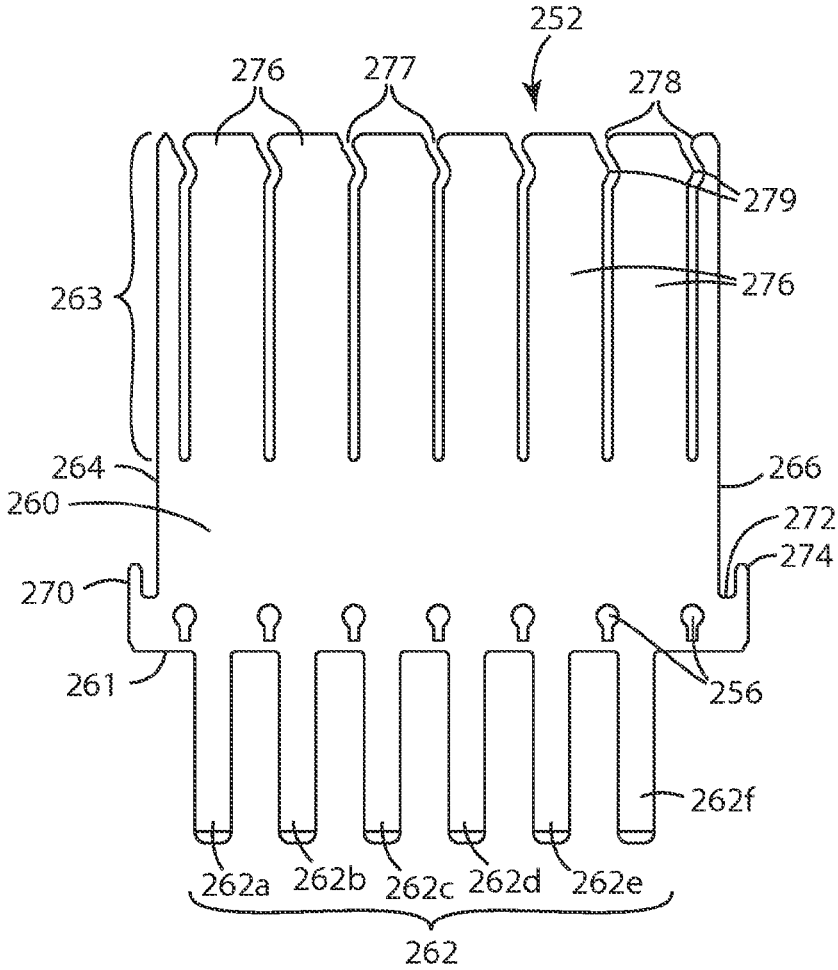
FIG. 5B is a top view of a column organizer plate of the organizer shown in FIG. 5A.
Figure 5C:
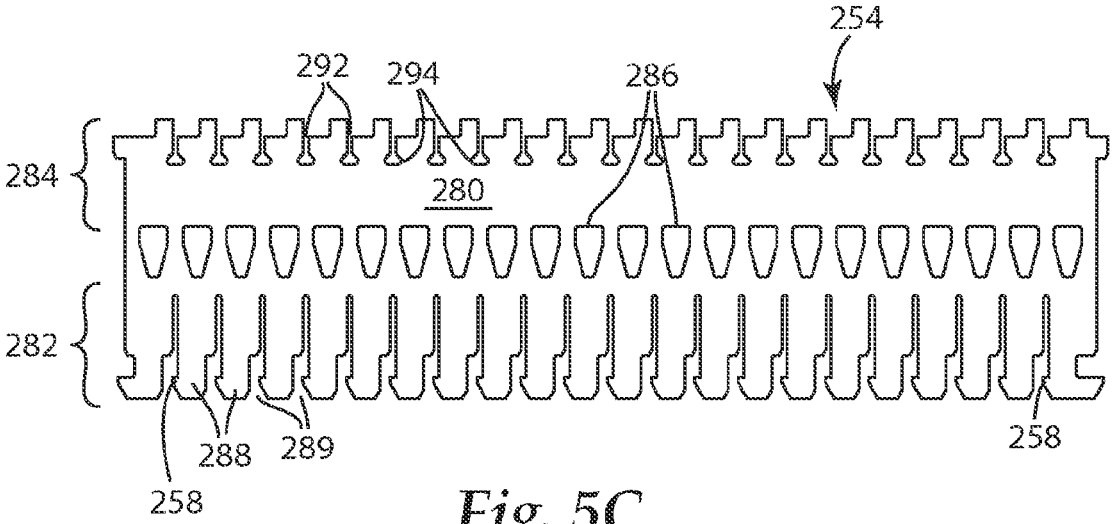
FIG. 5C is a top view of a row organizer plate of the organizer shown in FIG. 5A.

FIG. 5A is a perspective view of a portion of an organizer 250 and FIGS. 5B and 5C are top views of a column organizer plate 252 and a row organizer plate 254, respectively, that interlock to form organizer 250. Plates 252, 254 interlock to provide an organizer array configured to precisely align multiple termination devices 24 of a carrier assembly according to one embodiment.

Organizer 250 includes a column organizer plate 252 defining eye slots 256 and a row organizer plate 254 including locking hooks 258 that engage with eye slots 256 to securely assembly plates 252, 254 of organizer 250. Organizer 250 generally includes multiple column organizer plates 252 and multiple row organizer plates 254 co-interlocked at multiple junctions to form an array of openings sized to receive termination devices 24 (FIG. 1). The interlocked column and row organizer plates 252, 254 rigidly interlock to provide enhanced, precise positional accuracy of termination devices 24 inserted within organizer 250. One column organizer 252 and one row organizer 254 are illustrated in FIG. 5A for ease of illustration, although it is to be understood that multiple vertical column organizers 252 are typically interlocked with multiple horizontal row organizers 254.

FIG. 5B is a top view of column organizer 252, which includes a planar member 260 defining eye slots 256, a leading end 261, a trailing end portion 263, and fingers 262 extending, from leading end 261. In one embodiment, leading end 261 of column organizer 252 is substantially symmetric relative to opposing sides 264, 266 and includes six fingers 262*a*, 262*b*, 262*c*, 262*d*, 262*e*, 262*f* extending from leading end 261, although other numbers of fingers 262 are also acceptable. Fingers 262 extend from leading end 261 and are configured to provide a ground path extending between termination devices 24 that align with fingers 262 and a female carrier assembly into which the termination devices 24 and fingers 262 are insertable.

In one embodiment, planar member 260 defines a first hook 270 adjacent to side 264 and a second hook 274 adjacent to side 266. Hooks 270, 274 are formed to have depth stops 272. Hooks 270, 274 are configured to engage with a portion of a housing disposed over organizer 250 to minimize movement of organizer 250 relative to the housing and/or to prevent warping of the housing, which can undesirably displace the termination devices retained within the housing.

In one embodiment, trailing end portion 263 defines a plurality of tab segments 276 separated by slots 277, where at least one tab segment 276 includes a first locking tab 278 and a second locking tab 279. Slots 277 are sized to receive slotted portions of plates 254, as described below. Locking tabs 278, 279 are configured to engage with reciprocal slots provided by row organizer 254 to prevent plates 252, 254 from flexing one relative to the other, and minimize or prevent the flexing of fingers 262 when organizer 250 is assembled.

Suitable materials for plates 252, 254 of organizer 250 include metals and other electrically conductive materials, such as aluminum, alloys of aluminum, copper, alloys of copper, metals plated over substantially rigid substrates, or other suitable electrically conductive structures.

FIG. 5C is a top view of row organizer plate 254, which includes a planar member 280 defining a leading end portion 282, a trailing end portion 284, and centrally disposed latch openings 286.

In one embodiment, leading end portion 282 includes a plurality of tab segments 288 separated by slots 289, where tab segments 288 each include one of the locking hooks 258. Each of the slots 289 is sized to slide into one of the slots 277 formed in column organizer plate 252, and each locking hook 258 is configured to engage with a respective one of the eye slots 256 formed in planar member 260. When fully engaged, locking tabs 278, 279 of column organizer plate 252 engage with rear locking slots 292 and keyways 294 formed in row organizer plate 254, and the forward interlocking features of locking hooks 258 engaged with eye slots 256 to rigidly secure and precisely align the column and row organizer plates 252/254.

Figure 6A:
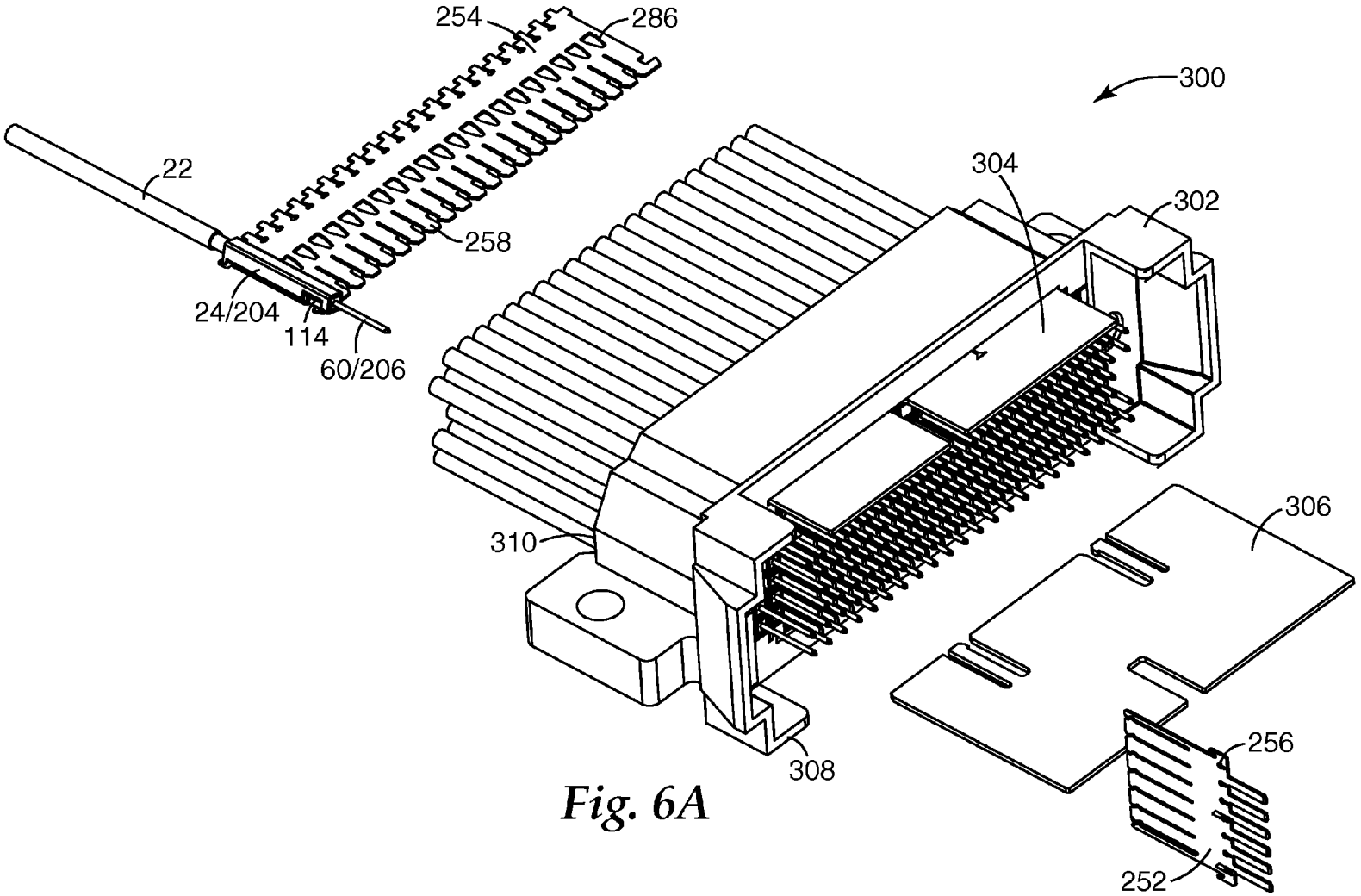
FIG. 6A is an exploded perspective view of a carrier assembly including interlocking column and row organizer plates configured to align and retain male coaxial connectors within a housing according to another embodiment.

FIG. 6A is an exploded perspective view of a carrier assembly 300 according to one embodiment. Carrier assembly 300 includes a housing 302 configured to enclose assembled organizer 250 and termination devices 24/204 inserted into organizer 250. Organizer 250 includes interlocking plates 252/254.

In one embodiment, housing 302 includes opposing support plates 304, 306 that stabilize column organizer plates 252 and row organizer plates 254. Column organizer plates 252 are generally inserted into a front 308 of housing 302. In an exemplary embodiment related to the complete assembly of carrier assembly 300, an individual cable 22 is terminated to a single termination device 24/204 that is coupled to row organizer plate 254 by engaging latch 110 (FIG. 1) with latch opening 286. The termination devices 24/204 as attached to the row organizer plate 254 are thereafter inserted into a rear 310 of housing 302 until locking hooks 258 on row organizer plate 254 engage with eye slot 256 on column organizer plate 252 and ground beam 114 of termination device 24/204 contacts column organizer plate 252.

Housing 302 retains organizer 250, and latches 110 (FIG. 1) engage with latch openings 286 to secure termination devices 24 within organizer 250. Operators will occasionally tug on cables 22 (FIG. 1) when replacing or servicing termination devices 24, and the interlocking features 256/258 are provided to resist movement of plates 252, 254. For example, a pulling force applied to a cable 22 of a termination device 24 engaged within organizer 250 by latch opening 286 could potentially retract one or more row organizer plates 254 from one or more column organizer plates 252.

The interlocking features 256/258 are provided to resist such movement and/or removal of row organizer plates 254 from column organizer plates 252. In addition, hooks 270, 274 engage with housing 302 to "tie" opposing walls of housing 302 together and minimize bowing of the walls of housing 302.

When assembled, male termination devices 24, 204 are disposed adjacent to planar members 260, 280 of column and row organizer plates 252, 254, pins 60/206 extend outward from termination devices 24/204, and fingers 262 extend beyond termination devices 24/204 to provide a ground pathway to an interconnected female carrier assembly.

Figure 6B:
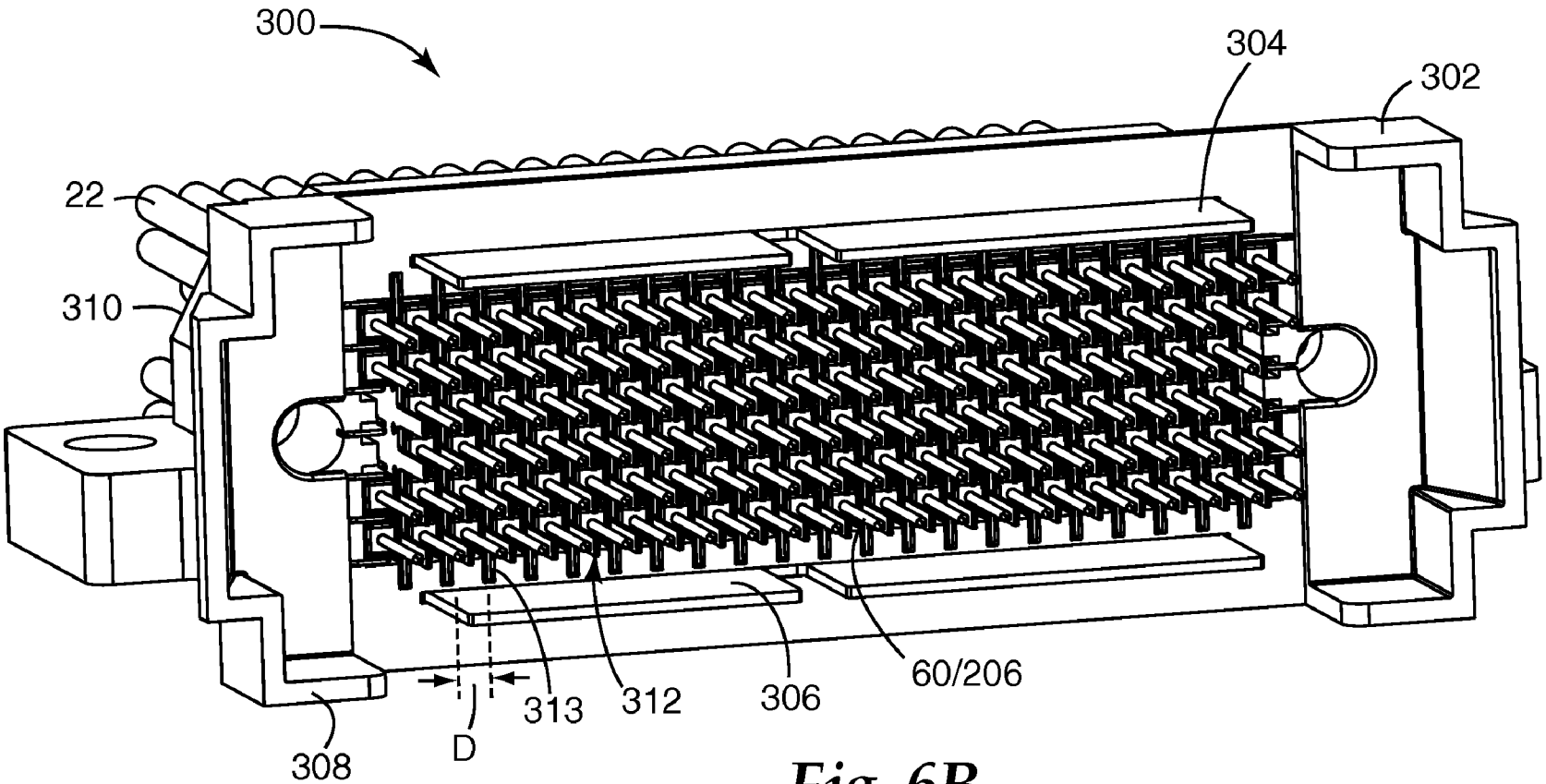
FIG. 6B is a perspective view of the carrier assembly shown in FIG. 6A assembled.

FIG. 6B is a perspective view of the carrier assembly 300 assembled. Organizer 250 within housing 302 defines an array of openings 312 separated by septums 313 for by the interlocking column and row organizer plates 252, 254. A termination device 24 is inserted in each opening 312. Interlocked plates 252/254 are spaced apart by a distance D that is selectively sized to receive differently sized termination devices. In one exemplary embodiment, the distance D is about 2 mm and openings 312 are sized to receive 1 mm shielded controlled impedance (SCI) termination devices 24/204. Alternatively, the distance D is about 4 mm and openings 312 are sized to receive 2 mm SCI termination devices 24/204.

In this embodiment, carrier assembly 300 provides an array of male termination devices 24/204 projecting from a front 308 of housing 302 such that housing 302 is characterized by an absence of a mating face between front 308 and termination devices 24. The septums 313 are thin and rigid and in an exemplary embodiment are formed of metal. Thin metal septums 313 are configured to provide support to housing 302 and engage with termination devices 24/204. In addition, thin metal septums 313 are not susceptible to "underfill" or other undesirable features associated with molded plastic dividers.

Known female carrier assemblies include a mating face defining apertures sized to receive pins that are inserted into the mating face. Mating faces positioned between two connected carrier assemblies have the potential to cause impedance discontinuities that arise because the mating face occupies a space between the pins. The mating face that is positioned between two connected carrier assemblies increases the space between the pins and between the assemblies, which results in less capacitive area on the grounding portions, thus resulting in increased impedance. In contrast, carrier assembly 300 is characterized by an absence of the mating face, is less expensive to fabricate, and has at least one less impedance discontinuity as compared to conventional carrier assemblies.

Figure 6C:
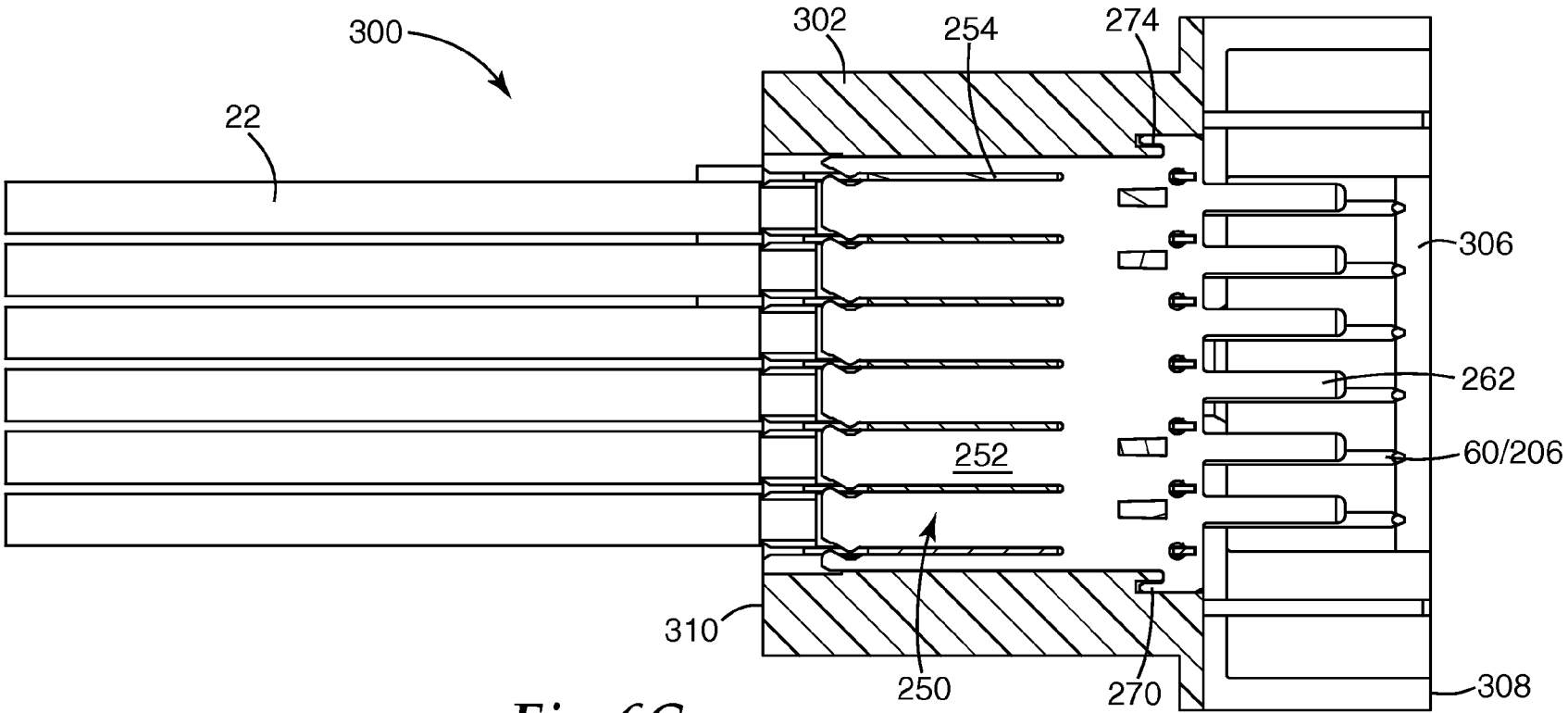
FIG. 6C is a cross-sectional view of the carrier assembly shown in FIG. 6B.

FIG. 6C is a cross-sectional view of the carrier assembly 300. Organizer 250 is secured within housing 302 in a manner that precisely aligns termination devices 24/204, in one embodiment, hooks 270, 274 engage with a portion of housing 302 to rigidly mount organizer 250 within housing 302. In one embodiment, housing 302 is molded over organizer 250 such that the molded material flows around hooks 270, 274 of column organizer plate 252 to rigidly engage organizer 250 within housing 302. Hooks 270, 274 of column organizer plate 252 engage with walls of housing 302 to minimize flexing and movement of the walls of housing 302 during use of the carrier assembly 300.

Figure 7:
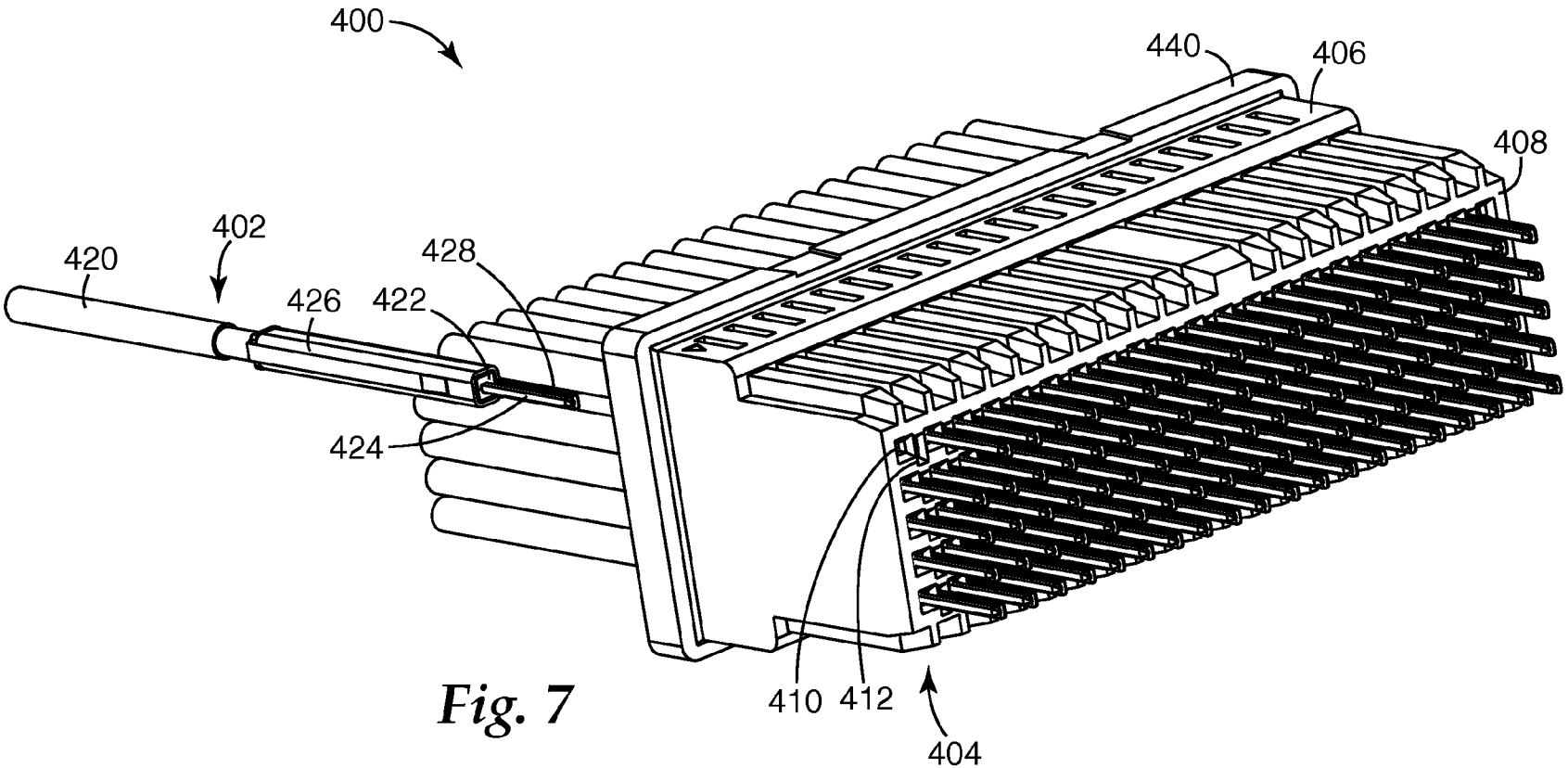
FIG. 7 is a perspective view of a male coaxial connector insertable into and configured to convert a female carrier assembly to a male carrier assembly according to another embodiment.

FIG. 7 is a perspective view of a male coaxial connector 402 insertable into and configured to convert a female housing 406 to a male carrier assembly 400. As a point of reference. FIG. 1 provides one embodiment of a male connector 20 formed in part by inserting pin 60 into receptacle 42; FIG. 4A provides another embodiment of a male connector 200 formed in part by inserting pin 206 into contact 209; and FIG.

7 provides another embodiment of male connector 402 employed to convert carrier assembly 404 a male carrier assembly 400.

Carrier assembly 404 includes housing 406 having a face 408 that defines apertures 410 and slots 412. Housing 406 is fabricated from a suitable material, such as plastic or another dielectric. Male coaxial connector 402 includes a cable 420 terminated to a contact (not shown) retained within an insulator 422, where insulator 422 defines a receptacle having a pin 424 inserted therein, and a shield body 426 that integrally forms a ground finger 428. Shield body 426 is isolated from pin 424 by insulator 422, and pin 424 electrically couples with cable 420.

Cable 420, insulator 422 and pin 424 are similar to cable 22, insulator 40, and pins 60/206 as described above. In this regard, pin 424 includes suitable signal pins terminated to a contact within male coaxial connector 402, or a pin that is soldered to a central conductor of cable 420.

Upon assembly, male coaxial connector 402 is inserted into a back wall 440 of housing 406 such that pin 424 projects through aperture 410 and ground finger 428 projects through slot 412. In this manner, carrier assembly 404 is converted to male carrier assembly 400 having pin 424 and ground finger 428 projecting from face 408.

Figure 8:
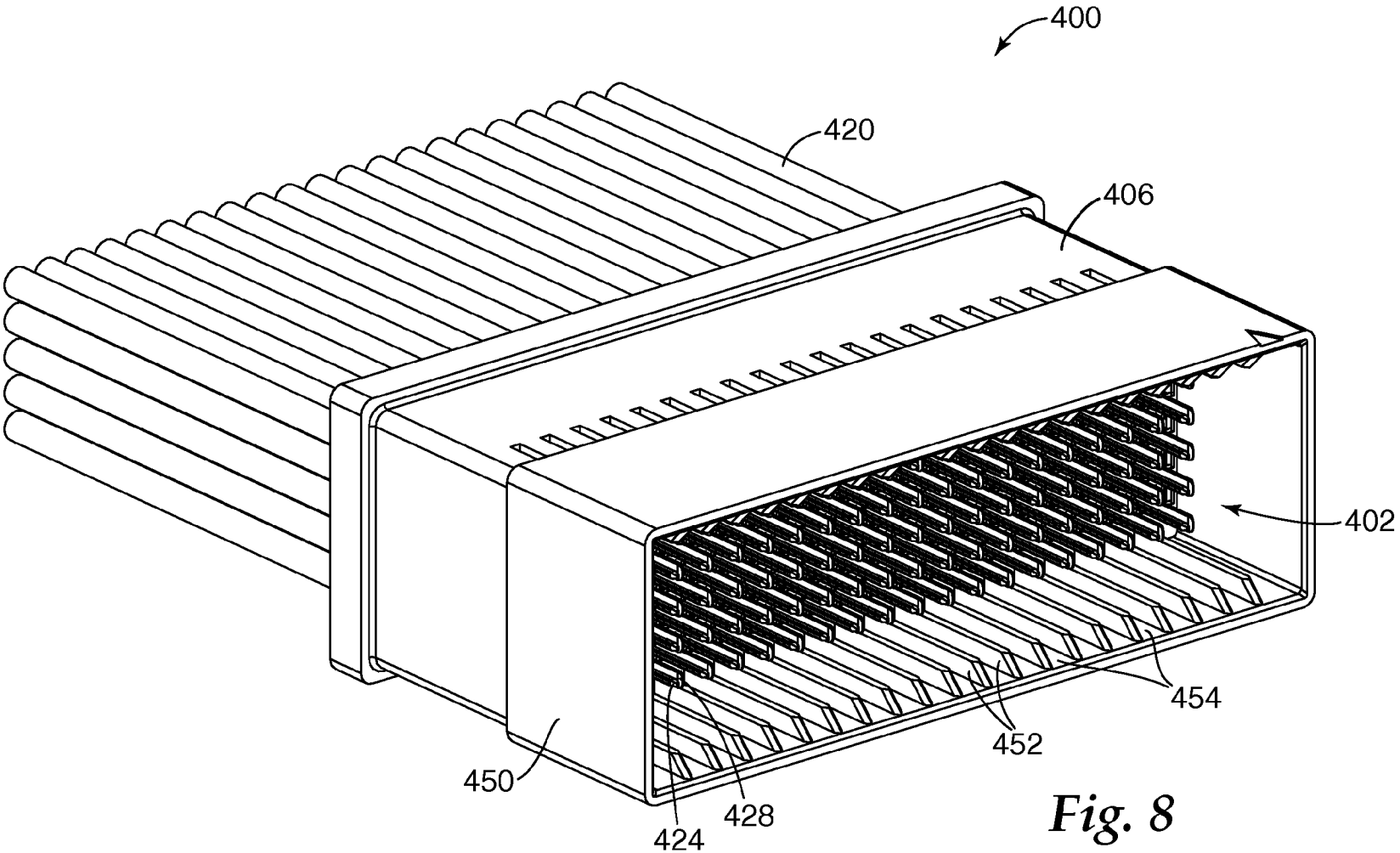
FIG. 8 is a perspective view of the converted male carrier assembly shown in FIG. 7 including a shroud.

FIG. 8 is a perspective view of male carrier assembly 400 including an optional shroud 450 attached to housing 406. Shroud 450 includes internal alignment fences 452 and alignment channels 454 that are formed between the alignment fences 452. The fences 452 and channels 454 are configured to engage with a leading end of housing 406 and provide an alignment mechanism suited to align pins 424 and ground fingers 428 with openings formed in a complementary female carrier assembly having a face similar to face 408.

Shroud 450 is generally fabricated of an electrically insulating material such as plastic. In one embodiment, shroud 450 is configured to be removably attachable to housing 406. In another embodiment, housing 406 and shroud 450 are integrally formed, for example by molding, into a one-piece unit.

Figure 9:
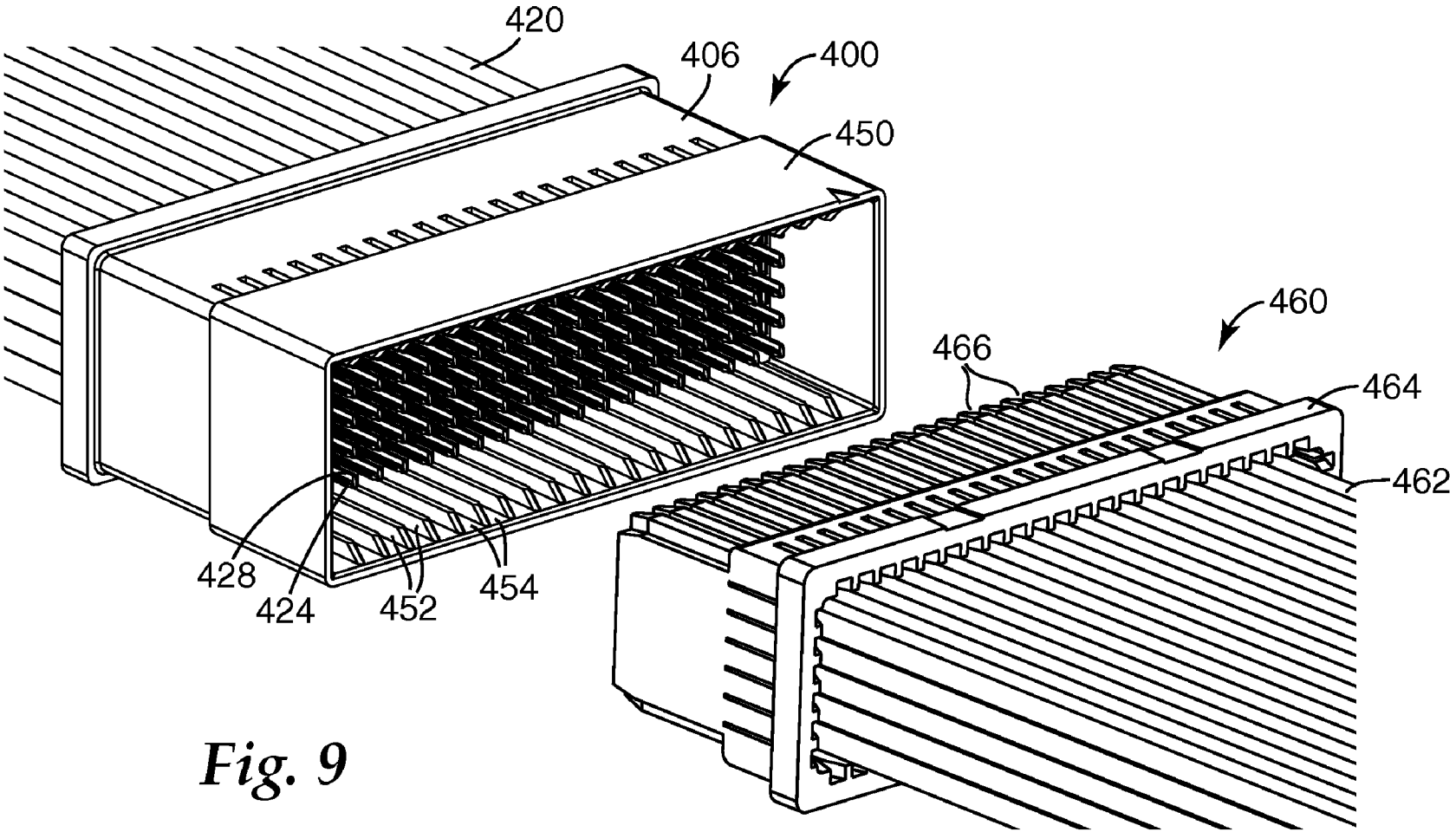
FIG. 9 is a perspective view of the converted male carrier assembly shown in FIG. 8 prior to coupling with a female carrier assembly.

FIG. 9 is a perspective view of male carrier assembly system 400 including shroud 450 positioned for coupling with a female carrier assembly 460. Female carrier assembly 460 includes cables 462 electrically terminated to termination devices (not shown) retained within a housing 464, where termination devices include a contact accessible through a socket and a ground wiper accessible through a slot. The termination devices retained within housing 464 are similar to the termination devices described in U.S. application Ser. No. 11/627,258 filed Jan. 25, 2007, which is incorporated herein in its entirety.

A leading end of housing 464 includes channels 466 configured to mate with fences 452 formed on shroud 450. Fences 452 align channels 466 to ensure that the sockets formed in female carrier assembly 460 align with and receive male pins 424, and that the slots in female carrier assembly 460 align with and receive ground fingers 428 when male carrier assembly 400 is interconnected with female carrier assembly 460. In one embodiment, shroud 450 is integrally formed with housing 406 to provide a rigid guide that minimizes rocking and wobbling between male carrier assembly 400 as it is inserted into female carrier assembly 460.

When male carrier assembly system 400 is interconnected with female carrier assembly 460, a ground circuit extends from each shield body 426 of the male connectors 402 through the ground finger 428 and to a separate ground beam of the connected female termination device.

Figure 10:
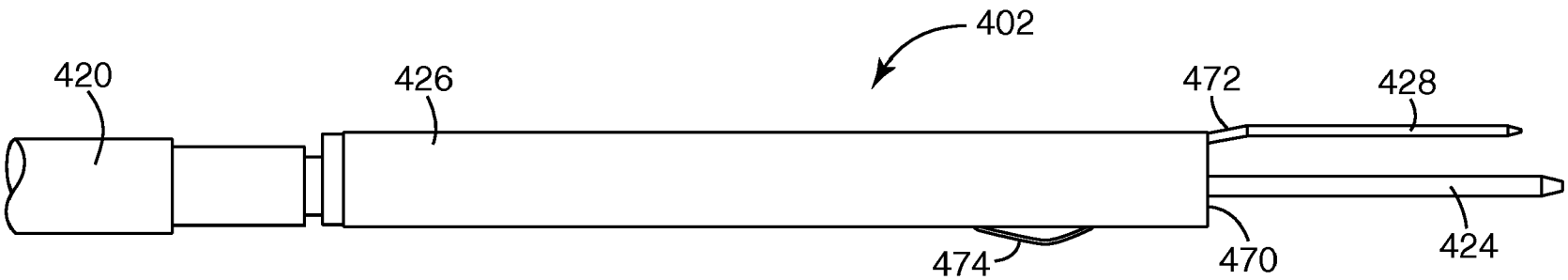
FIG. 10 is a top view of the male coaxial connector shown in FIG. 7.

FIG. 10 is a top view of male coaxial connector 402. In one embodiment, shield body 426 is formed of metal, and ground finger 428 is formed as part of shield body 426 and extends from leading end 470 of shield body 426. Male coaxial connector 402 is configured to electrically couple with and complete a ground circuit with a female termination assembly similar to female connector/termination assembly 142 (FIG. 3).

With additional reference to FIG. 3, pin 424 is insertable into receptacle 152 formed by female connector 142 and ground finger 428 is configured to contact or terminate against ground wiper 154. In one embodiment, ground finger 428 includes a clearance step 472 that is configured to enable ground finger 428 to be directed around tubular shield 150 to an exterior portion of tubular shield 150 when male coaxial connector 402 is inserted into female connector 142.

Pin 424 and ground finger 428 project from shield body 426 to define a male connector. In one embodiment, shield body 426 is fabricated as a single-piece unit that includes ground finger 428. In one embodiment, an optional resilient ground beam 474 is provided that projects from shield body 426. When optional ground beam 474 is provided, it configures male coaxial connector 402 to be inserted into an organizer to provide a carrier assembly in a mariner that optional ground beam 474 electrically contacts one of the column organizer plate 252 or the row organizer plate 254 of such an organizer 250 (FIG. 5A) to commonly ground the male coaxial connectors 402 of the assembly. Other suitable forms of resilient ground beams are also acceptable. In addition, shield body 426 suitably includes latches or other coupling devices as described above.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of embodiments of male electrical connectors and their associated carrier assemblies employed to convert female connectors or carrier assemblies into male connectors or carrier assemblies as discussed herein. Therefore, it is intended that this invention be limited only by the claims and the equivalents thereof.

What is claimed is:

1. A male coaxial connector comprising:

a coaxial cable comprising a central conductor terminated to a termination device, the termination device comprising:

an insulator defining a receptacle extending between first and second ends of the insulator;

a first shield disposed around the insulator;

a pin inserted into the receptacle and electrically contacting the central conductor of the cable, the pin being electrically isolated from the first shield by the insulator;

a plate electrically contacting the first shield, and an insulative housing surrounding the first shield and the plate and securing the plate against the first shield; wherein the pin and the plate extend beyond the first shield and the insulative housing, the pin being configured to be a male signal pin for coupling into a female receptacle and the plate being configured to provide a ground path with the female receptacle.

2. The male coaxial connector of claim 1, wherein the coaxial cable comprises a second shield surrounding the central conductor, and wherein the first shield electrically contacts the second shield.

* * * * *

UNITED STATES PATENT AND TRADEMARK OFFICE

CERTIFICATE OF CORRECTION

PATENT NO. : 7,909,646 B2
APPLICATION NO. : 12/538560
DATED : March 22, 2011
INVENTOR(S) : Steven Feldman It is certified that error appears in the above-identified patent and that said Letters Patent is hereby corrected as shown below:

Column 2,
Line 43, delete “scope,” and insert --scope-- therefor.

Column 4,
Line 62, delete “ground,” and insert --ground-- therefor.

Column 8,
Line 17, delete “for” and insert --formed-- therefor.

Column 8,
Line 52, delete “24/204, in” and insert --24/204. In-- therefor.

Column 8,
Lines 63-64, delete “reference.” and insert --reference,-- therefor.

Column 10,
Line 20, delete “mariner” and insert --manner-- therefor.

Signed and Sealed this
Ninth Day of August, 2011

David J. Kappos

David J. Kappos
*Director of the United States Patent and Trademark Office*